US008172087B2

(12) United States Patent
Fryars

(10) Patent No.: US 8,172,087 B2
(45) Date of Patent: May 8, 2012

(54) SEPARATION APPARATUS

(75) Inventor: Thomas Fryars, Clitheroe (GB)

(73) Assignee: Tek-Dry Systems Limited, Horwich, Bolton (GB)

( * ) Notice: Subject to any disclaimer, the term of this patent is extended or adjusted under 35 U.S.C. 154(b) by 0 days.

(21) Appl. No.: 12/646,760

(22) Filed: Dec. 23, 2009

(65) Prior Publication Data

US 2010/0163464 A1 Jul. 1, 2010

(30) Foreign Application Priority Data

Dec. 24, 2008 (GB) ..... 0823495.7

(51) Int. Cl.
*B07B 4/00* (2006.01)

(52) U.S. Cl. ..... 209/138; 209/133; 209/142; 209/145; 209/147; 209/717

(58) Field of Classification Search ..... 209/133, 209/138, 142, 145, 147, 717
See application file for complete search history.

(56) References Cited

U.S. PATENT DOCUMENTS 3,164,548 A * 1/1965 Rowell et al. ..... 209/139.1
3,362,414 A * 1/1968 Wochnowski ..... 131/312
3,522,012 A * 7/1970 Blann ..... 422/162
3,836,085 A * 9/1974 Brown ..... 241/19
3,918,586 A * 11/1975 Tyler et al. ..... 209/586
4,132,634 A * 1/1979 Rumpf et al. ..... 209/136
4,755,284 A * 7/1988 Brooks et al. ..... 209/20
4,853,112 A * 8/1989 Brown ..... 209/142
5,099,863 A * 3/1992 Coleman ..... 131/312
5,344,025 A * 9/1994 Tyler et al. ..... 209/35
2010/0163464 A1* 7/2010 Fryars ..... 209/138
2011/0031166 A1* 2/2011 Graham ..... 209/19

* cited by examiner

*Primary Examiner* — Terrell Matthews
(74) *Attorney, Agent, or Firm* — Hodgson Russ LLP

(57) ABSTRACT

Disclosed is a separation apparatus comprising a conveyor; and a material separator positioned above a conveyor, the conveyor being arranged to convey a mixture of materials to the material separator; the material separator comprising a suction duct comprising a sidewall which defines a passageway linking an inlet positioned adjacent the conveyor to an outlet positioned away from the conveyor; and an airflow generator arranged to blow air through a slit in the sidewall into the passageway at a position between the inlet and the outlet; wherein, in use, the airflow generator blows air through the slit in a direction which is towards the outlet for creating a pressure difference between the inlet and the outlet thereby generating an airflow which causes relatively low density materials to be lifted from the conveyor and sucked into the passageway.

22 Claims, 6 Drawing Sheets

SEPARATION APPARATUS

CROSS-REFERENCE TO RELATED APPLICATIONS

The present application claims priority benefit of United Kingdom Patent Application No. GB0823495.7, filed on Dec. 24, 2008, which is hereby incorporated by reference.

BACKGROUND OF THE INVENTION

The present invention relates to separation apparatus and to methods for separating materials.

Separation apparatus are used in the recycling industry to separate mixtures of materials for separate processing. Examples of such mixtures include: a mixture of glass fragments mixed together with particles of shredded paper; shredded or news paper mixed together with heavy plastics such as food containers and bottles; and metal cans mixed together with plastics and other materials.

Known separation apparatus use an air moving device such as a fan or blower to separate the mixture of materials into like fragments. However, with said known separation apparatus, materials displaced can come into contact and become tangled in a rotating element of the fan or blower thereby rendering the separation apparatus inoperable.

BRIEF SUMMARY OF THE INVENTION

According to the present invention there is provided a separation apparatus and method of separating materials as set forth in the appended claims. Other features of the invention will be apparent from the dependent claims, and the description which follows.

According to the present invention in a first aspect there is provided a separation apparatus. The separation apparatus may comprise a material separator positioned above a conveyor. The conveyor may be arranged to convey a mixture of materials to the material separator for separation. The material separator may comprise a suction duct comprising a sidewall. The sidewall may define a passageway linking an inlet positioned adjacent the conveyor to an outlet positioned away from the conveyor. The material separator may comprise an airflow generator arranged to blow air through a slit in the sidewall into the passageway at a position between the inlet and the outlet. In use, the airflow generator may blow air through the slit in a direction which is towards the outlet. Blowing air towards the outlet may create a pressure difference between the inlet and the outlet to generate an airflow caused by air being sucked into the inlet. The sucking of air into the inlet may cause the relatively low density materials to be lifted from the conveyor and sucked into the passageway from the mixture of materials leaving relatively high density materials on the conveyor.

According to the present invention in a second aspect there is provided a material separator for use in a separation apparatus, such as the separation apparatus of the first aspect. The material separator may comprise a suction duct comprising a sidewall which defines a passageway linking an inlet positioned to an outlet. The material separator may also have an airflow generator arranged to blow air through a slit in the sidewall into the passageway at a position between the inlet and the outlet. In use, the airflow generator may blow air through the slit in a direction which is towards the outlet for creating a pressure difference between the inlet and the outlet to generate an airflow from the inlet to the outlet which creates a suction effect at the inlet.

The pressure difference may create an even airflow between the inlet and the outlet. The suction effect caused by the airflow may be at its strongest along the sidewall. The ability to create a suction effect by air through the sidewall into the passageway at a positioned spaced apart from the inlet may minimise the amount of displaced material that may come into contact with a blower or fan of the airflow generator.

Suitably, the airflow generator is arranged to blow air in a direction which is perpendicular to the conveyor for generating an airflow that is perpendicular to the conveyor.

Suitably, the airflow generator comprises a supply fan for blowing air through the slit. Suitably, the airflow generator comprises an air collection chamber in fluid communication with the supply fan and the slit. Suitably, in use, the supply fan blows air into the air collection chamber where it is collected before being pushed through the slit. Suitably, the air is pushed through the slit at high pressure. Suitably, an air entry point of the supply fan into the air collection chamber is spaced apart from the slit. Suitably, the air entry point is on a wall of the air collection chamber opposed to the wall on which the slit is located. Suitably, a wall of the air collection chamber is the sidewall of the suction duct.

Suitably, the sidewall is shaped to define a funnel shaped passageway; wherein the inlet is defined by the relatively narrow part of the funnel and the outlet is defined by the relatively wide part of the funnel.

The funnel shaped passageway may create an aerofoil effect which cause the airflow to be even or laminar.

Suitably, the slit runs circumferentially around the sidewall. Suitably, the slit runs around the sidewall in a direction which is parallel to the conveyor.

Suitably, the slit is positioned at a point between a first section of the sidewall and a second section of the sidewall. Suitably, in the first section, the sidewall is dimensioned to define a passageway comprising a smaller width than the second section. Suitably, in the second section, the width of the sidewall is varied to define a passageway that expands from the gap (slit) to the outlet. Suitably, a top edge of the first section is positioned adjacent a bottom edge of the second section in a direction that is parallel to the conveyor. Suitably, the top edge and bottom edge define the slit. In this way, the airflow from the first section into the second section is such that an air barrier may be defined over the slit to minimise the likelihood of the low density material entering into the slit and becoming entangled or contacting the means for blowing air of the airflow generator.

Suitably, the sidewall defines a passageway which is circular in cross-section. Suitably, the sidewall defines a passageway which is polygonal in cross-section.

Suitably, the sidewall defines a passageway in the first section which is circular in cross-section. Suitably, the sidewall defines a passageway in the first section which is polygonal in cross-section. Suitably, the sidewall defines a passageway in the second section which is circular in cross-section. Suitably, the sidewall defines a passageway in the second section which is polygonal in cross-section.

Suitably, the conveyor is a vibratory conveyor comprises a first level. Suitably, the first level comprises a first conveying member which is arranged along a bottom surface extending from a bottom edge of the sidewall. Suitably, the first conveying member comprises an operative end in which an edge is shaped and dimensioned to correspond to the shape of the inlet. Suitably, in use, the first conveying member is positioned such that the generated air flow causes the low density material to be sucked from the operative end into the inlet leaving the high density material to fall from the operative end. Suitably, the operative end is positioned beneath the inlet so that the edge of the operative end is aligned with an edge of the inlet.

Suitably, the first conveying member is annular in shape. The edge of the operative end may be an aperture shaped and dimensioned to correspond to the inlet. Alternatively, the first conveying member is rectangular in shape. An edge of the operative end may comprise a first region which is shaped and dimensioned to correspond to the inlet and second regions either side of the first region, which are shaped to be angled away from the inlet.

Suitably, when the first conveying member is annular in shape, the first conveying member may comprise a wall and a floor. The wall may stand up from the floor on an edge opposed to the operative end.

Suitably, when the first conveying member is rectangular in shape, the first level may comprise a plurality of first conveying members. Suitably, the first conveying member comprises a wall and a floor. Suitably, the wall stands up from the floor around the edges of the first conveyor leaving a gap in the first region through which the high density material falls from the first level, in use. The wall may define a chute-like conveyor arranged to channel the mixture of material to the operative end.

Suitably, the vibratory conveyor comprises a second level beneath the first level relative to the inlet. Suitably, the second level comprises a second conveying member that comprises an operative end that extends beyond the edge of the first conveying member towards the centre of the inlet. Suitably, an edge of the operative end is arced or straight.

Suitably, a gap between the bottom surface of the suction duct and the first level and a gap between the first level and the second level define a first and second air channel through which air is drawn into the inlet. The air channels may create an even air flow that lifts the low density material from the high density material as the air is sucked towards and into the inlet.

Suitably, a first and second sidewall is arranged to connect the first level to the second level to form a walled air channel through which air is blown, in use, to aid the separation of low density material from high density material.

Suitably, the conveyor is an endless conveyor. Suitably, the conveyor revolves at a predetermined speed. Suitably, the predetermined speed is selected to allow the airflow to act on the mixture of materials for a predetermined time to lift and separate the low density material from the high density material.

Suitably, the conveyor is a predetermined height from the inlet. The predetermined height may be selected to ensure that the strength of the airflow acting upon the mixture of materials is such that the low density materials are separated from the high density materials.

The separation apparatus of any preceding claim in which a discharge duct is connected to the outlet to channel the low density material away from the material separator to a first collection point, whilst the high density materials are conveyed to a second collection point.

According to a second aspect of the present invention there is provided a method of separating low density materials from high density material contained in a mixture of materials. The method may comprise the steps of: conveying a mixture of materials to an operative point; and generating at the operative point an airflow by blowing air through a slit in a sidewall of a duct into a passageway linking an inlet to an outlet. The air that is blown through the slit in a direction which is towards the outlet may create a pressure difference between the inlet and the outlet that may in turn generate an airflow at the operative point which may cause the relatively low density materials to be lifted and sucked into the inlet and out through the outlet whilst the relatively high density materials are conveyed away from the operative point.

The method may further comprise channelling the low density materials away from the suction duct into a first collection point and routing the high density materials to a second collection point.

BRIEF DESCRIPTION OF THE DRAWINGS

For a better understanding of the invention, and to show how embodiments of the same may be carried into effect, reference will now be made, by way of example, to the accompanying diagrammatic drawings in which.

DETAILED DESCRIPTION OF THE INVENTION

FIGS. 1-10 show exemplary embodiments of a separation apparatus 1,2,3 of the present invention. The separation apparatus 1,2,3 comprises an air moving part 10 to which a mixture of waste materials to be separated is conveyed. The air moving part 10 is a material separator and features an airflow generator 11 and a suction duct 12. In use, the airflow generator 11 creates an airflow in the suction duct 12 of sufficient velocity to lift and suck low density materials from the mixture of waste materials into the duct 12, whilst the high density materials are conveyed away from the suction duct 12.

Figure 1:
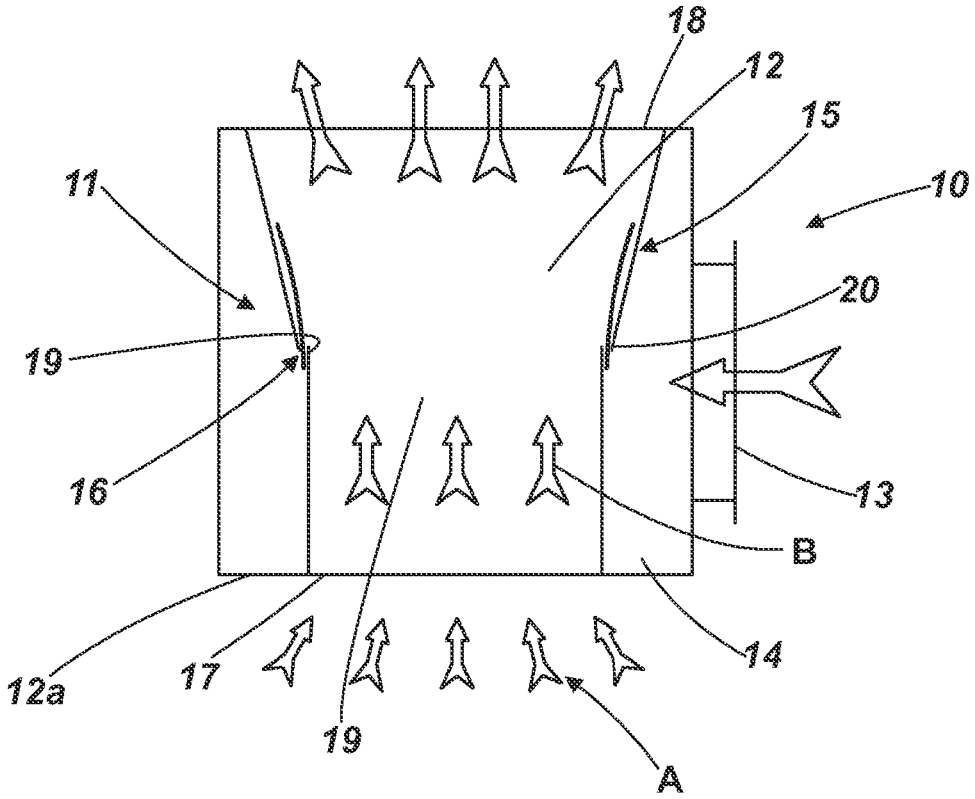
FIG. 1 shows a sectional side view of an air moving device of an embodiment of the present invention.

FIG. 1 shows the airflow generator 11 that comprises a supply fan 13 and an air collection chamber 14. The supply fan 13 is in fluid communication with the air collection chamber 14 and supplies air into the air collection chamber for subsequent distribution to the suction duct 12. The supply fan uses a 15 kw blower to supply pressurised air to the air collection chamber 14.

It is of course possible for any type and power of supply to be used to blow air into the air collection chamber.

The air collection chamber 14 is an annular chamber which surrounds the suction duct 12. That is, the walls of the air collection chamber are arranged to surround the suction duct 12 and share a sidewall 15 with the suction duct. Pressurised air is supplied from the air collection chamber to the suction duct 12 through a slit 16 in the sidewall 15.

The slit 16 runs circumferentially around the sidewall 15 in a direction which is parallel to a bottom surface 12*a* of the suction duct 12. In the suction duct 12, the slit 16 is located in a position between the inlet 17 and the outlet 18. For example, the slit is located equidistant between the inlet and the outlet. In other examples, the slit can be arranged in any position between the inlet and outlet.

The slit 16 is defined by a gap in the sidewall 15 between a first section and a second section of a passageway 19 defined by the sidewall 15. The sidewall 15 defines a funnel-shaped passageway 19. The first section runs from the inlet 17 to the slit 16 and the second section runs from the slit 16 to the outlet 18. The first section is cylindrical in shape and has the same width or diameter along its length. The second section is conical in shape and has a varying width from the slit 16 to the outlet 18. The cone shaped second section can be arranged to expand at any angle relative to the sidewall of the first section. For example, the cone shape expands at an angle of 15° relative to the sidewall of the first section.

The side wall of the example embodiment shown in FIG. 1 defines a passageway 19 with a circular cross-section when viewed in plan. However, the sidewall can be configured to define a passageway of any shape or combination of shapes, for example, elliptical, or polygonal such as a quadrilateral, pentagonal, hexagonal, heptagonal and octagonal.

The sidewall is dimensioned such that the passageway 19 in the first section is in the region of 0.70 m-1.5 m. For example, the width or diameter of the sidewall is 1.12 m. The sidewall is dimensioned such that the passageway 19 in the second section expands from 0.75 m at the slit 16 to 1.12 m at the inlet 18. For example, the sidewall 15 is dimensioned to expand to define a passageway 19 with a width of 1.12 m at the outlet 18.

Figure 2:
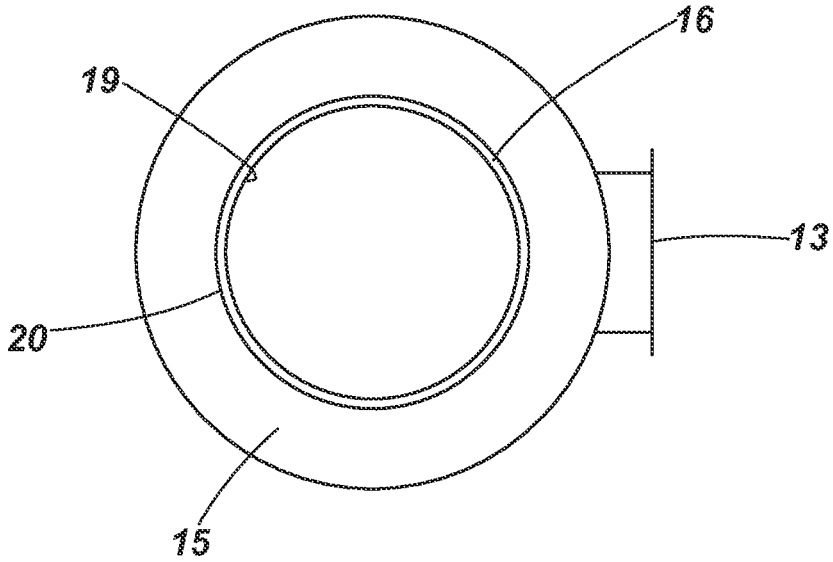
FIG. 2 shows a plan view of an air moving device of an embodiment of the present invention.

FIG. 2 shows that a top edge 19 of the first section, i.e. the edge opposed to the inlet 17, is located in a region in which a bottom edge 20 of the second section, i.e. the edge opposed to the outlet 18, is also located. The top edge 19 and the bottom edge 20 are displaced in a direction parallel to the bottom surface 12*a* by a predetermined distance to define the slit 16. The size of the slit 16 in the sidewall 15 is predetermined to create the desired pressure difference between an inlet 17 and an outlet 18 of the suction duct 12. The slit 16 could be in the range of 14-24 mm in width. For example, the slit 16 could be 19 mm in width.

In operation, the speed of the pressurised air flowing from the air collection chamber 14 through the slit 16 is in the region of 75-95 metres per second. FIG. 1 shows that due to the shape and angle of the cone shaped second section, the pressurised air follows the profile of the cone like an aerofoil. This even or laminar airflow shown by the arrows A creates a pressure difference between the sidewall of the second section and a central region of the second section. That is, an area of low pressure is generated in the central region. This area of low pressure creates a vacuum-like effect, which sucks air in from a relatively high pressure area surrounding the inlet 17 and through the passageway 19 as shown by the arrows B. This sucked in air being discharged through the outlet 18.

In use, the airflow along the sidewall 15 also creates an air boundary that covers the slot. The airflow boundary acts to minimise the amount of light density material that is able to inadvertently pass through the slit into the air collection chamber 14.

Figure 3:
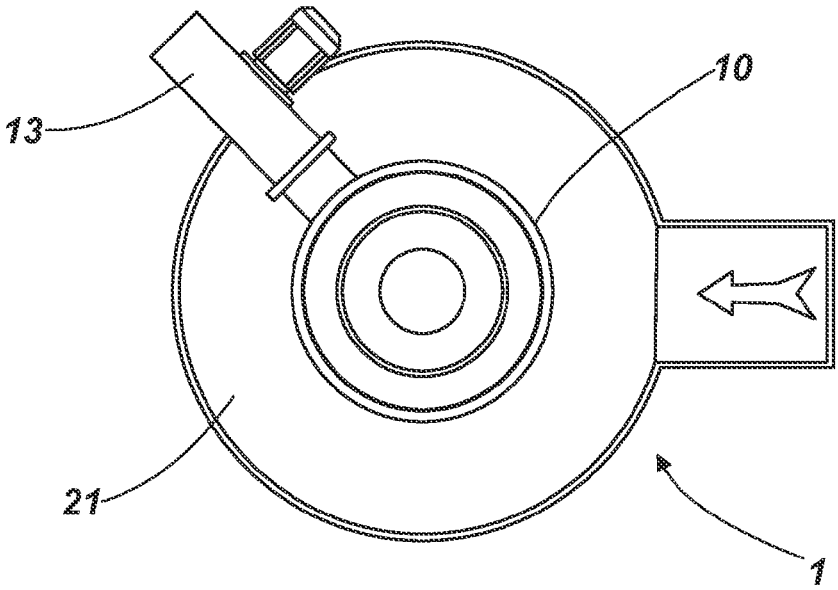
FIG. 3 shows a plan view of a separation apparatus of an embodiment of the present invention.

FIG. 3 shows a first embodiment of a separation apparatus 1 in which the material separator 10 described above is used to suck low density material in through the inlet 17. In use, a mixture of materials is conveyed to the inlet 17 with a vibratory conveyor 21, which is annular in shape. The vibratory conveyor 21 has a first end 23 which is fed the mixture of materials by a feed conveyor 24, and an opposed operative end 25 at which the low density materials are separated from the high density materials in the mixture. Standing up from the first end 23 is a wall that, in use, reduces the amount of material that may otherwise inadvertently fall from the first end 23.

The mixture of materials can be of any type of materials. One such type is a by-product of common recycling facilities in which less dense particles are mixed up with more dense particles. For example, the mixture of materials can be of broken glass and paper, such as shredded or news paper; heavy plastics such as food containers and bottles, and lighter plastics or paper; Metal cans or plastics and other light fractions.

The vibratory conveyor 21 is positioned beneath the inlet 17 to run parallel to the bottom surface 12*a*. The vibratory conveyor 21 has two levels. Each level has a conveying member 26, 27. A first conveying member 26 of the first level is spaced apart from the bottom surface 12*a*. A second conveying member 27 of the second level is spaced apart from the first conveying member 26.

The size of gap between the bottom surface 12*a* and a floor 28 of the first conveying is predetermined according to the type of materials to be separated. The size of the gap is in the range of 50 mm to 150 mm. For example, to separate a mixture of glass and paper the gap is 100 mm when the air flow speed from the inlet 17 to the outlet 18 is, for example, 85 metres per second.

The size of the gap between the floor 28 of the first conveying member 26 and the floor 29 of the second conveying member is between 100 mm to 200 mm, for example 150 mm.

The conveying members 26, 27 each have an operative end, which define an aperture through the conveying members 26, 27. The first conveying member 26 has an operative end 25*a* shaped and dimensioned to define an aperture that corresponds to the inlet 17. The second conveying member has an operative end 25*b* which is shaped to correspond to the inlet, but is dimensioned so that, when viewed in plan, the second conveying member extends beyond the operative end 25*a* of the first conveying member. That is, the aperture defined in the first conveying member 26 has a larger diameter than the aperture defined in the second conveying member 27.

Figure 4:
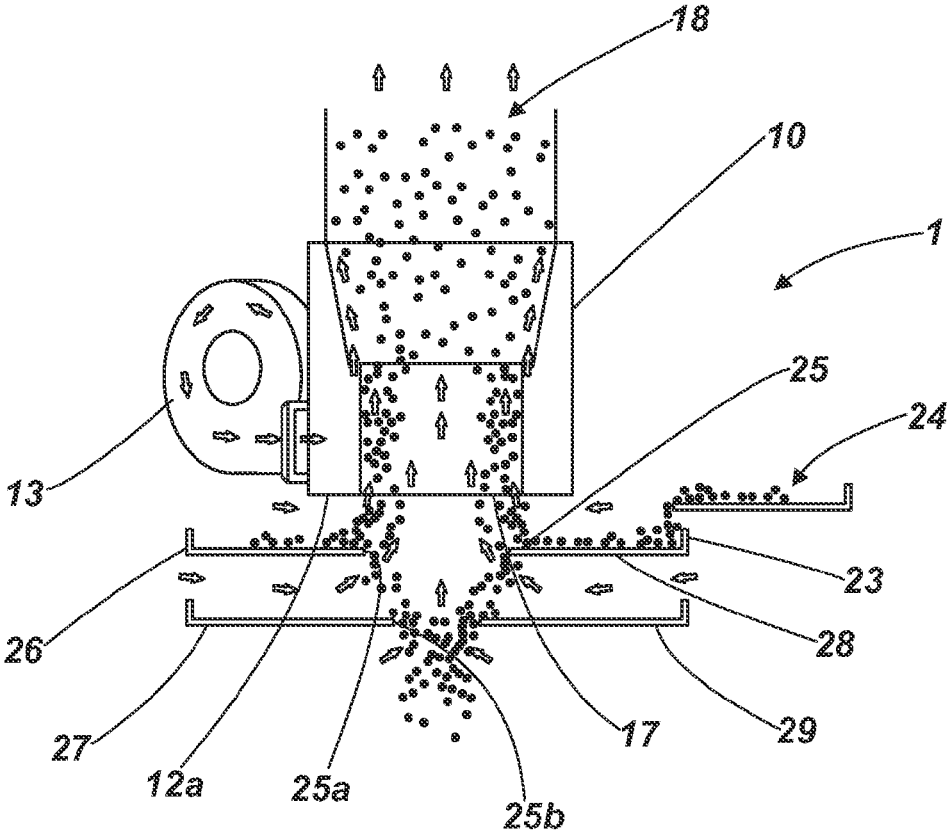
FIG. 4 shows a sectional side view of the separation apparatus of FIG. 3.

FIG. 4 shows the vibratory conveyor 21 of the first embodiment in operation. Here, an edge of the operative end 25*b* of the first conveying member 26 is arranged to be level with an edge of the inlet 17. When the air is sucked in through the inlet, air is drawn in through the gap between the bottom surface 12*a* and the first conveying member 26. This air disturbs the mixture of materials, which are fed onto the vibratory conveyor 21 from a feed conveyor 24. At a point at which the air is drawn into the inlet, i.e. at the edge of the inlet, the low density material is sucked into the suction duct 11. At the same time as the low density material is drawn into the suction duct, the high density material falls due to gravity from the conveyor onto the second conveying member 27. The low density material is then channelled through the suction duct 12 into a discharge duct. The discharge duct channels the low density material to a first collection point. Meanwhile, the high density material falls due to gravity through the aperture in the second conveyor into a second collection point.

In use, air is also drawn in through the gap between the first conveying member 26 and the second conveying member 27, and through the aperture defined in the second conveying member. In this way a plurality of air channels feed air into the inlet, creating an even or laminar airflow at the operative end 25*a* which separates the low density material from the high density materials.

In the embodiment shown in FIGS. 3 and 4 the first conveying member 26 is not connected to the second conveying member 27, and the members 26, 27 vibrate independently. However, it should be understood that the conveying members 26, 27 can also be connected to vibrate in unison.

Figure 5:
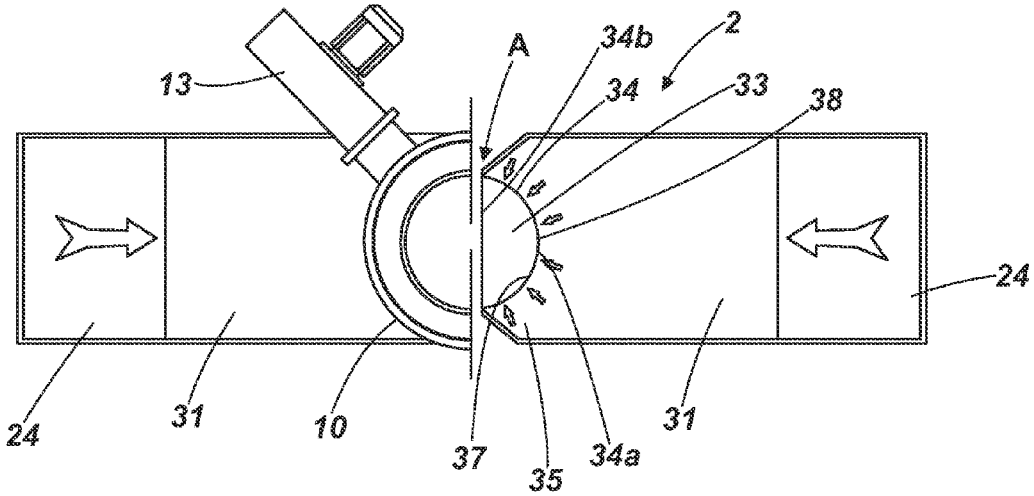
FIG. 5 shows a plan view the separation apparatus of another embodiment of the present invention showing a partial section at point A.
Figure 6:
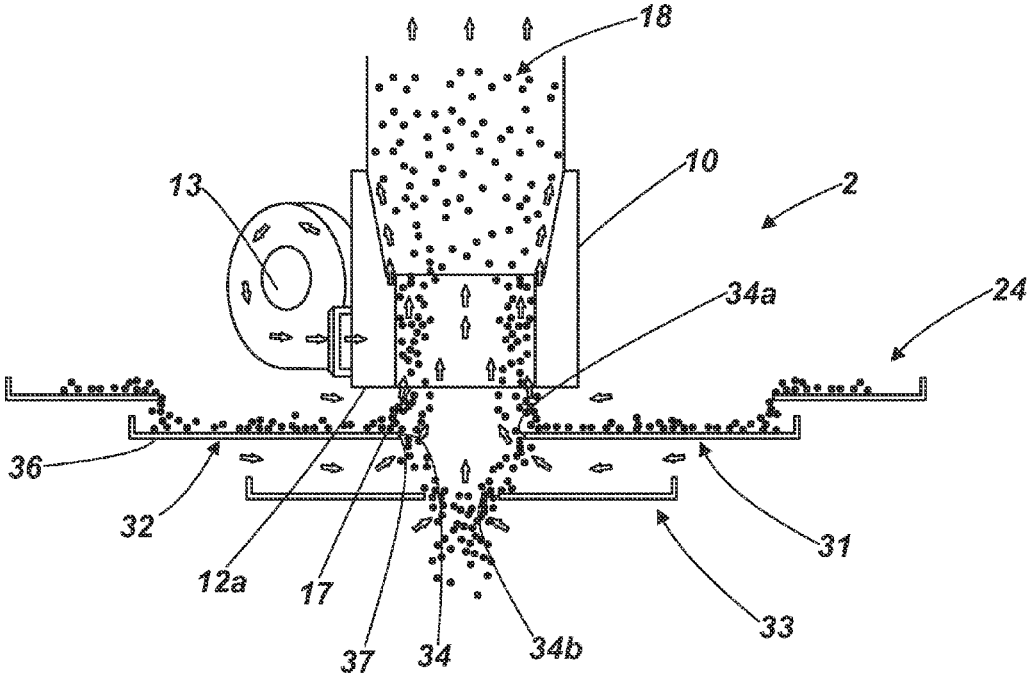
FIG. 6 shows a sectional side view of a separation apparatus of the embodiment shown in FIG. 5.

FIGS. 5 and 6 show a second embodiment of a separation apparatus 2 in which the material separator 10 described above is used to suck low density material in through the inlet 17. In the second embodiment the conveyor is vibratory conveyor 31. However, in contrast to the first embodiment, the conveyor 31 is quadrilateral in shape, for example rectangular. The operation and features of the conveyor 31 are substantially the same as those described for the first embodiment. The differences between the conveyor 21 and the conveyor 31 will now be described.

In the second embodiment the vibratory conveyor comprises a plurality of separate vibratory conveyors. Each one of the plurality of separate vibratory conveyors 31 has a first conveying member 32 arranged above a second conveying member 33. Both of the first and second conveying members have an operative end 34, which is arranged adjacent the inlet 17, in use.

The operative end 34*a* of the first conveying member 32 has an edge 37 which has a first region 38 either side of which are second regions 35. The first region 38 is arced and defines a semi-circular edge which corresponds in shape and dimension to the edge of the inlet 17. In the second region 35, the edge is angled away from edge of the first region 38.

In the first conveying member 32, a wall stands up from the floor 36 around its edge. No wall is provided in the first region 38. In use, the walls in the second region 35 act like a chute to channel the mixture of materials to the operative end.

In use, the low density material is sucked from the operative end 34*a* at or in the vicinity of the first region 38. The high density material falls due to gravity onto the second conveying member 33. The second conveying member 33 also has a first region and a second region in which an edge 34*b* is a straight edge in the first region in a line from the end of one second region to the other. As with the first conveyor, the edge of the second region is angled away from the edge of the first region.

In the second conveying member a wall can optionally be provided.

The first and second embodiments described above feature an arrangement in which air flow is induced between the first and second conveying members 26 & 27 and 32 & 33 by the suction effect created by the air moving part 10. This air flow aids the separation effect of the separation apparatus.

Figure 7:
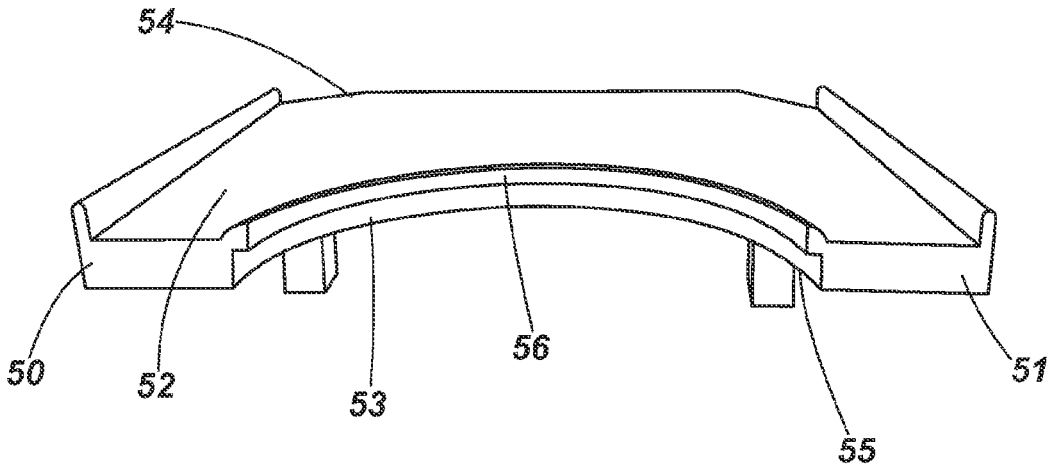
FIG. 7 shows a perspective view of a vibratory conveyor for use with an air moving device of an embodiment of the present invention.

In a further embodiment of the separation apparatus (not shown), a vibratory conveyor as shown in FIG. 7 is used. The vibratory conveyor is substantially the same as those described for the separation apparatus of the first and second embodiments. In this further embodiment, those vibratory conveyors are supplemented by providing a first and second sidewall 50, 51 to connect a first conveying member 52 to a second conveying member 53. The sidewalls 50, 51 are provided to define a walled channel having a first end and a second end 54, 55.

In use, a fan blower is arranged to blow air into the first end. The fan blower forces air to move through the channel from the first end 54 to the second end 55. The air exits from the second end 55 through a slit 56. In use, the second end is arranged in the vicinity of the inlet 17. Upon exiting the second end, the forced air acts upon the low density and high density material in the vicinity of the inlet 17 to supplement the separating effect of the air moving apparatus 10. That is, the air leaving the slit 56 imparts an upward vertical component of force to the low density material to aid the separation effect.

Figure 8:
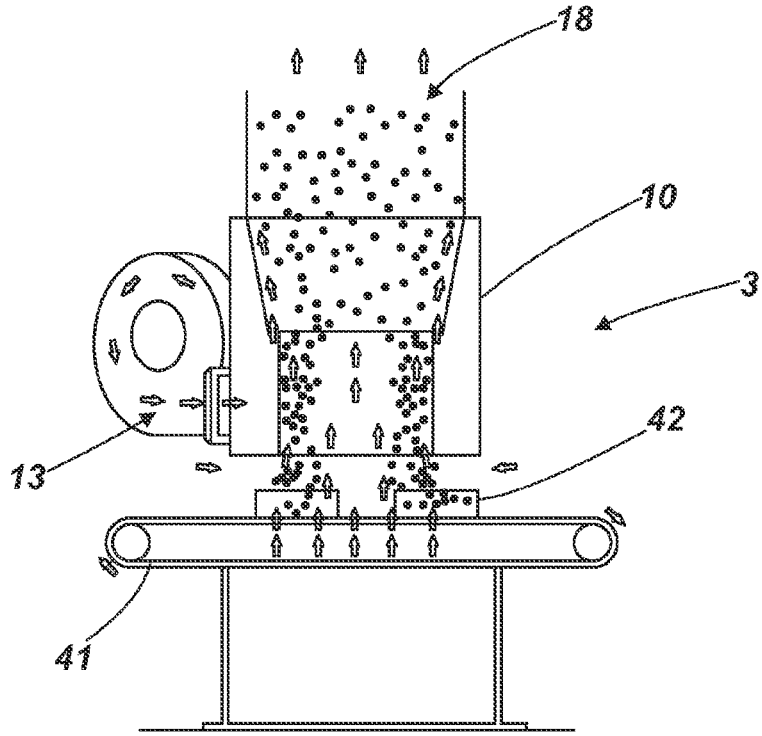
FIG. 8 shows a sectional side view of a separation apparatus of a still further embodiment of the present invention.
Figure 9:
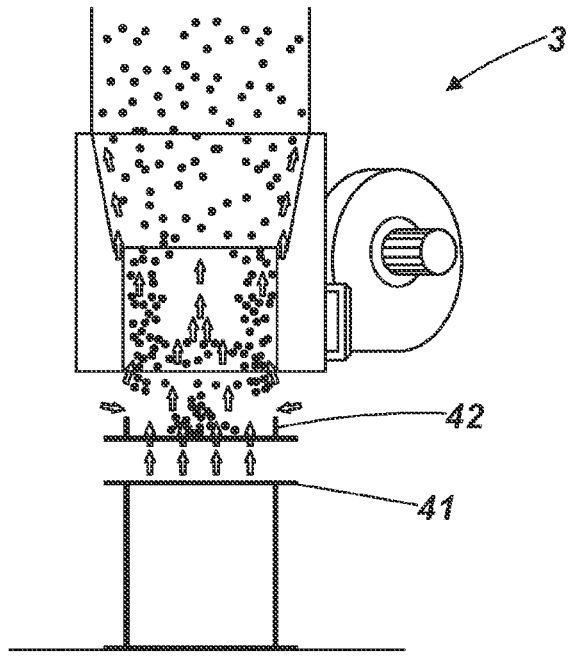
FIG. 9 shows a sectional front view of the separation apparatus of FIG. 8.
Figure 10:
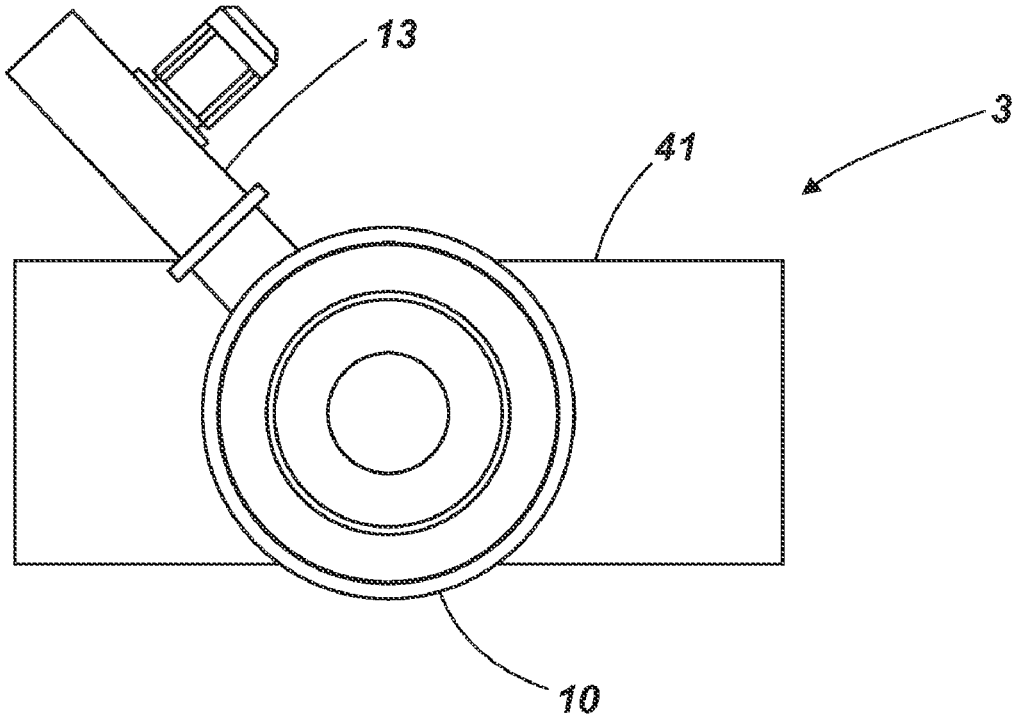
FIG. 10 shows a plan view of the separation apparatus of FIG. 8.

FIGS. 8-10 show a third embodiment of a separation apparatus 3 in which the material separator 10 described above is used to suck low density material in through the inlet 17. In the third embodiment the conveyor is an endless conveyor 41. The operation of the separation apparatus is the same as described for the first embodiment, except the second and third air channels of the first embodiment are not present due to the vibratory conveyor consisting of one level.

In use, the endless conveyor is supplied with a mixture of materials, which are transported at a predetermined speed to the material separator 10. As the mixture of materials nears the inlet 17 the materials are disturbed. When the materials are at, or are in close vicinity to, the inlet 17, the low density materials are lifted from the conveyor and sucked into the suction duct 12 leaving the high density materials on the conveyor. Subsequently, the low density materials are channelled to a first collection point and the high density materials are channelled to a second collection point.

As shown in FIGS. 8 and 9 the endless conveyor processes discrete containers 42, which contain the mixture of materials. However, it should be understood that the endless conveyor can have sidewalls and process a continuous stream containing a mixture of materials.

The conveyor has a continuous a web of material which allows air to be drawn through the conveyor 41 to create a second air channel to increase the evenness or laminar nature of the air flowing into the inlet 17. However, it should be understood the endless conveyor can comprise a solid belt.

The endless conveyor may also be a vibratory conveyor in addition.

Although a few preferred embodiments have been shown and described, it will be appreciated by those skilled in the art that various changes and modifications might be made without departing from the scope of the invention, as defined in the appended claims.

Attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

What is claimed is:

1. A separation apparatus comprising:

a conveyor; and a material separator, the conveyor being arranged to convey a mixture of materials to the material separator;

the material separator comprising:

a suction duct positioned above the conveyor, and comprising a sidewall which defines a passageway linking an inlet positioned adjacent the conveyor to an outlet positioned away from the conveyor; and an airflow generator arranged to blow air through a slit in the sidewall into the passageway at a position between the inlet and the outlet;

wherein, in use, the airflow generator blows air through the slit in a direction which is towards the outlet for creating a pressure difference between the inlet and the outlet thereby generating an airflow which causes relatively low density materials to be lifted from the conveyor and sucked into the passageway.

2. The separation apparatus of claim 1 in which the airflow generator is arranged to blow air in a direction which is perpendicular to the conveyor for generating an airflow that is perpendicular to the conveyor.

3. The separation apparatus of claim 1 in which the airflow generator comprises a supply fan for blowing air through the slit.

4. The separation apparatus of claim 3 in which the airflow generator comprises an air collection chamber in fluid communication with the supply fan and the slit; wherein, in use, the supply fan blows air into the air collection chamber where it is collected before being pushed through the slit.

5. The separation apparatus of claim 1 in which the slit runs circumferentially around the sidewall in a direction which is parallel to the conveyor.

6. The separation apparatus of claim 1 in which the sidewall is shaped to define a funnel shaped passageway; wherein the inlet is defined by a relatively narrow part of the funnel and the outlet is defined by a relatively wide part of the funnel.

7. The separation apparatus of claim 1 in which the slit is positioned at a point between a first section of the sidewall and a second section of the sidewall; wherein, in the first section, the sidewall is dimensioned to define a passageway comprising a smaller width from the inlet to the slit than the width of the passageway of the second section; and in the second section the width of the sidewall is varied to define a passageway that expands from the gap to the outlet.

8. The separation apparatus of claim 7 in which a top edge of the first section is positioned adjacent a bottom edge of the second section in a direction that is parallel to the conveyor; wherein a gap between the top edge and bottom edge defines the slit.

9. The separation apparatus of claim 1 in which the conveyor is a vibratory conveyor comprising a first level; wherein the first level comprises a first conveying member which is arranged along a bottom surface extending from a bottom edge of the sidewall, wherein the first conveying member comprises an operative end in which an edge is shaped and dimensioned to correspond to the shape of the inlet; and wherein, in use, the first conveying member is positioned such that the generated air flow causes the low density material to be sucked from the operative end into the inlet leaving the high density material to fall from the operative end.

10. The separation apparatus of claim 9 in which an edge of the operative end comprises a first region which is shaped and dimensioned to correspond to the inlet and second regions either side of the first region which are shaped to be angled away from the inlet.

11. The separation apparatus of claim 9 in which the vibratory conveyor comprises a second level beneath the first level relative to the inlet; wherein the second level comprises a second conveying member that comprises an operative end that extends beyond the edge of the first conveying member towards the centre of the inlet.

12. The separation apparatus of claim 11 in which a gap between the bottom surface of the suction duct and the first level and a gap between the first level and the second level define a first and second air channel through which air is drawn into the inlet.

13. The separation apparatus of claim 11 in which a first and second sidewall is arranged to connect the first level to the second level to form a walled air channel through which air is blown, in use, to aid the separation of low density material from high density material.

14. The separation apparatus of claim 1 in which the conveyor is an endless conveyor; wherein the conveyor revolves at a predetermined speed.

15. A material separator for use in a separation apparatus comprising:

a suction duct comprising a sidewall which defines a passageway linking an inlet positioned to an outlet; and an airflow generator arranged to blow air through a slit in the sidewall into the passageway at a position between the inlet and the outlet;

wherein, in use, the airflow generator blows air through the slit in a direction which is towards the outlet for creating a pressure difference between the inlet and the outlet to generate an airflow from the inlet to the outlet which creates a suction effect at the inlet.

16. A method of separating low density materials from high density material contained in a mixture of materials, the method comprising the steps of:

conveying a mixture of materials to an operative point;

generating at the operative point an airflow by blowing air through a slit in a sidewall of a duct into a passageway linking an inlet to an outlet;

wherein the air is blown through the slit in a direction which is towards the outlet for creating a pressure difference between the inlet and the outlet to generate an airflow at the operative point which causes the relatively low density materials to be lifted and sucked into the inlet and out through the outlet whilst the relatively high density materials are conveyed away from the operative point.

17. The method of claim 16 in which the air is blown in a direction which is perpendicular to the direction in which the mixture of materials is being conveyed.

18. The method of claim 16 in which the sidewall defines a funnel shaped passageway; wherein the air blown through the slit follows the sidewall in an aerofoil-like manner to create a low pressure region which causes air to be sucked evenly in through the inlet and out through the outlet.

19. The method of claim 16 in which the mixture of materials is conveyed on a vibratory conveyor from which the low density materials are sucked from the conveyor into the inlet.

20. The method of claim 16 in which the mixture of materials is conveyed on an endless conveyor from which the low density materials are sucked from the conveyor into the inlet.

21. The method of claim 16 in which at least two air channels are created in a first level and a second level, the first level being directly beneath the suction duct and the second level being beneath the first level; wherein air is sucked in from both air channels into the inlet to lift the low density materials from the high density materials.

22. The method of claim 16 further comprising channelling the low density materials away from the suction duct into a first collection point and routing the high density materials to a second collection point.

* * * * *